US008133433B2

(12) United States Patent
Hansen

(10) Patent No.: US 8,133,433 B2
(45) Date of Patent: Mar. 13, 2012

(54) BISMUTH-INDIUM AMALGAM, FLUORESCENT LAMPS, AND METHODS OF MANUFACTURE

(76) Inventor: Steven C. Hansen, Urbana, IL (US)

( * ) Notice: Subject to any disclaimer, the term of this patent is extended or adjusted under 35 U.S.C. 154(b) by 859 days.

(21) Appl. No.: 11/526,720

(22) Filed: Sep. 26, 2006

(65) Prior Publication Data

US 2007/0071635 A1 Mar. 29, 2007

Related U.S. Application Data

(60) Provisional application No. 60/720,037, filed on Sep. 26, 2005.

(51) Int. Cl.
*C22C 12/00* (2006.01)
*H01J 17/26* (2006.01)

(52) U.S. Cl. ..... 420/577; 252/181.1; 252/181.2; 252/181.7; 313/565

(58) Field of Classification Search .... 252/181.1–181.7; 313/547–551, 553–562, 564–565; 420/577
See application file for complete search history.

(56) References Cited

U.S. PATENT DOCUMENTS

| | | | | |
|---|---|---|---|---|
| 4,145,634 | A | 3/1979 | Evans et al. | |
| 4,157,485 | A | 6/1979 | Wesselink et al. | |
| 4,216,178 | A | 8/1980 | Anderson | |
| 4,419,303 | A | 12/1983 | Anderson | |
| 4,469,980 | A | 9/1984 | Johnson | |
| 4,615,846 | A * | 10/1986 | Yoshino et al. | 264/13 |
| 4,924,142 | A | 5/1990 | Kaldenhoven | |
| 5,882,237 | A | 3/1999 | Sarver et al. | |
| 5,952,780 | A * | 9/1999 | Forsdyke et al. | 313/565 |
| 6,791,254 | B2 | 9/2004 | Stafford et al. | |
| 2001/0013754 | A1 * | 8/2001 | Honmou et al. | 313/490 |
| 2001/0038264 | A1 * | 11/2001 | Brumleve et al. | 313/565 |
| 2002/0180340 | A1 * | 12/2002 | Hansen | 313/490 |
| 2003/0151351 | A1 * | 8/2003 | Stafford et al. | 313/490 |
| 2005/0170101 | A1 * | 8/2005 | Ramsey | 427/487 |

FOREIGN PATENT DOCUMENTS

| | | |
|---|---|---|
| EP | 0 136 866 | 4/1985 |
| JP | 61186408 | 8/1986 |
| JP | 63066842 | 3/1988 |
| JP | H08509569 A | 10/1996 |

* cited by examiner

*Primary Examiner* — Stanley Silverman
*Assistant Examiner* — Brian Walck
(74) *Attorney, Agent, or Firm* — Duane Morris LLP

(57) ABSTRACT

The disclosure relates to fluorescent lamps and methods of manufacture wherein the mercury is dosed into the lamp in a solid material containing mercury, bismuth, indium and another metal. In one embodiment, the metal is selected from the group consisting of zinc, tin, lead, silver, gold, copper, gallium, titanium, nickel, and manganese. Preferably, the atomic ratio of the indium to the bismuth is in the range of about 0.4:0.6 to 0.7:0.3. The atomic ratio of zinc to the combination indium and bismuth may preferably be in the range of about 0.01:0.99 to 0.20:0.80, and the atomic ratio of mercury to the combination of the indium, bismuth and zinc is preferably in the range of about 0.01:0.99 and 0.15:0.85.

30 Claims, 4 Drawing Sheets

A = Bi-In-Hg (prior art)

B = Bi-In-Zn-Hg (this invention)

BISMUTH-INDIUM AMALGAM, FLUORESCENT LAMPS, AND METHODS OF MANUFACTURE

This application claims priority to the filing-date of U.S. Provisional Application No. 60/720,037, filed Sep. 26, 2005, the specification of which is incorporated herein in its entirety by reference.

BACKGROUND

The disclosure generally relates to low-pressure mercury discharge lamps. More specifically, the disclosure relates such lamps having a lamp fill including mercury, bismuth and indium, and methods of dosing the lamp with the fill material using substantially solid mercury-containing pellets of high purity, uniform size, and uniform composition.

Fluorescent lamps are well known and contain a vaporizable lamp fill including mercury. In the manufacture of such lamps, it is necessary to introduce very small amounts of mercury into the light emitting chamber of the lamp. For example, some fluorescent lamps include only about 0.1 mg up to about 10 mg of mercury, depending on the size of the lamp. While it is possible to introduce liquid mercury directly into the lamp, it is very difficult to obtain precise doses of such small quantities of mercury due to the high surface tension of mercury. Consequently, lamps dosed by using liquid mercury usually contain more mercury than is needed for operation of the lamp leading to environmental concerns in the disposal of the lamps. To address these concerns, mercury has been combined with other elements to form a substantially solid lamp fill material, thereby easing the handling and dispensing of the material while providing a means for dosing precise amounts of mercury into the lamp.

Another concern is maintaining the mercury vapor pressure at a level such that the lamp operates efficiently within a range of temperatures. The mercury vapor atoms convert electrical energy into ultraviolet radiation. The mercury vapor pressure is preferably in the range of approximately $2\times10^{-3}$ to $2\times10^{-2}$ Torr and optimally, about $6\times10^{-3}$ Torr. The ultraviolet radiation is in turn absorbed by a phosphor coating on the interior of the lamp wall and converted to visible light. As the operating temperature of the lamp increases, the mercury vapor pressure increases and more of the ultraviolet radiation is self-absorbed by the mercury, thereby lowering the efficiency of the lamp and reducing light output. Thus, the mercury vapor pressure must be controlled. Conventionally, in one type of fluorescent lamp the mercury vapor pressure is controlled by controlling the temperature of the lamp. In another type of fluorescent lamp, the mercury vapor pressure is controlled by adding a mercury vapor pressure regulating material to the lamp.

Lamps in which a mercury vapor pressure regulating material is utilized for mercury vapor pressure control typically operate with a cold spot temperature of above 75° C. and generally have a small diameter. Such lamps are known as "compact lamps", and typically require an amalgamative metal in addition to mercury in the lamp fill for mercury vapor pressure control. U.S. Pat. No. 4,157,485 discloses an indium-bismuth-mercury amalgam that is used to control the mercury vapor pressure in a low pressure mercury vapor discharge lamp, i.e., fluorescent lamp, over a wide temperature range. The goal of the amalgam is to maintain the mercury vapor pressure at $6\times10^{-3}$ Torr (the optimum vapor pressure for a fluorescent lamp) over as wide of temperature range as possible. Although the indium-bismuth amalgam maintains a lower mercury vapor pressure at room temperature than pure mercury, the mercury vapor pressure is sufficient for the lamp to start. At temperatures above about 40° C. (which is the optimum mercury vapor pressure for a lamp with pure mercury) the efficiency of a lamp containing only mercury decreases while a lamp containing an indium-bismuth amalgam remains greater than 90% of the possible light output for temperatures up to about 130° C. The upper temperature limit is determined primarily by the chemical composition and the mercury content of the amalgam. U.S. Pat. No. 4,157,485 discloses an indium-bismuth amalgam wherein the ratio of atoms of bismuth to atoms of indium is between 0.4:0.6 and 0.7:0.3 and the ratio of atoms of mercury to the sum of the atoms of bismuth and indium is between 0.01:0.99 and 0.15:0.85.

The composition of the indium-bismuth-mercury pellets in commercial typically use is 28 to 32 weight percent indium, 64 to 69 weight percent bismuth and 1.5 to 5.0 weight percent mercury. However, the manufacture and production of lamps using an amalgam with this composition is difficult because of a small amount of liquid amalgam present in the pellet. The pellets agglomerate at substantially room temperature and are difficult to separate. Thus the pellets are not "free flowing", i.e., the pellets tend to stick together when in contact and will not roll over other pellets. The self-agglomeration may occur immediately after the pellets are manufactured or it may occur after several weeks have passed. The poor flow properties of the abovementioned amalgam composition cause significant problems with handling, dosing and lamp manufacture. Self-agglomeration of these amalgams can cause waste in the lamp manufacturing environment and limit the use of these amalgams.

Accordingly, it is an object of the disclosure to address the above-mentioned problems and to provide novel lamp fill materials, methods of dosing fluorescent lamps, and methods of improving the handling characteristics of lamp fill materials containing mercury. It is a further object to provide novel lamp fill materials forming free flowing solids. It is yet another objection of the present disclosure to provide pellets having a composition of mercury, bismuth, indium and another metal wherein the pellets are free flowing an include material that regulates the mercury vapor pressure during operation of fluorescent lamps. It is another object of the disclosure to regulate the mercury vapor pressure within a low pressure mercury discharge lamp with indium-bismuth-mercury amalgam. It is still a further object of the disclosure to improve the manufacture of low pressure mercury vapor discharge lamps with an indium-bismuth-zinc-mercury amalgam. It is yet a further object of the disclosure to provide a novel method of introducing a precise amount of mercury into an amalgam-controlled fluorescent lamp.

These and many other objects and advantages of the disclosure will be readily apparent to one skilled in the art to which the invention pertains from a perusal of the claims, the appended drawings, and the following description.

DETAILED DESCRIPTION

Figure 1:
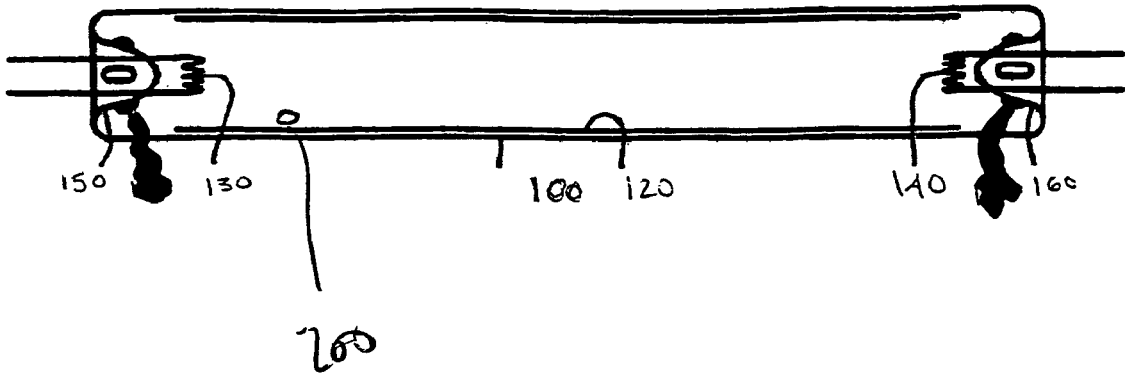
FIG. 1 is a schematic illustration of a fluorescent lamp according to one embodiment of the disclosure.

FIG. 1 is a schematic illustration of a mercury vapor discharge lamp according to one embodiment of the disclosure.

The lamp 100 may be of standard size suitable for installation and use in conventional ceiling fixtures. The inner wall of the lamp 100 may include the phosphor coating 120. The thermal electrodes 130 and 140 are positioned at the ends of the discharge space. The lamp 100 may include one or more lamp fill pellets 200 having a composition according to the present disclosure.

Figure 2:
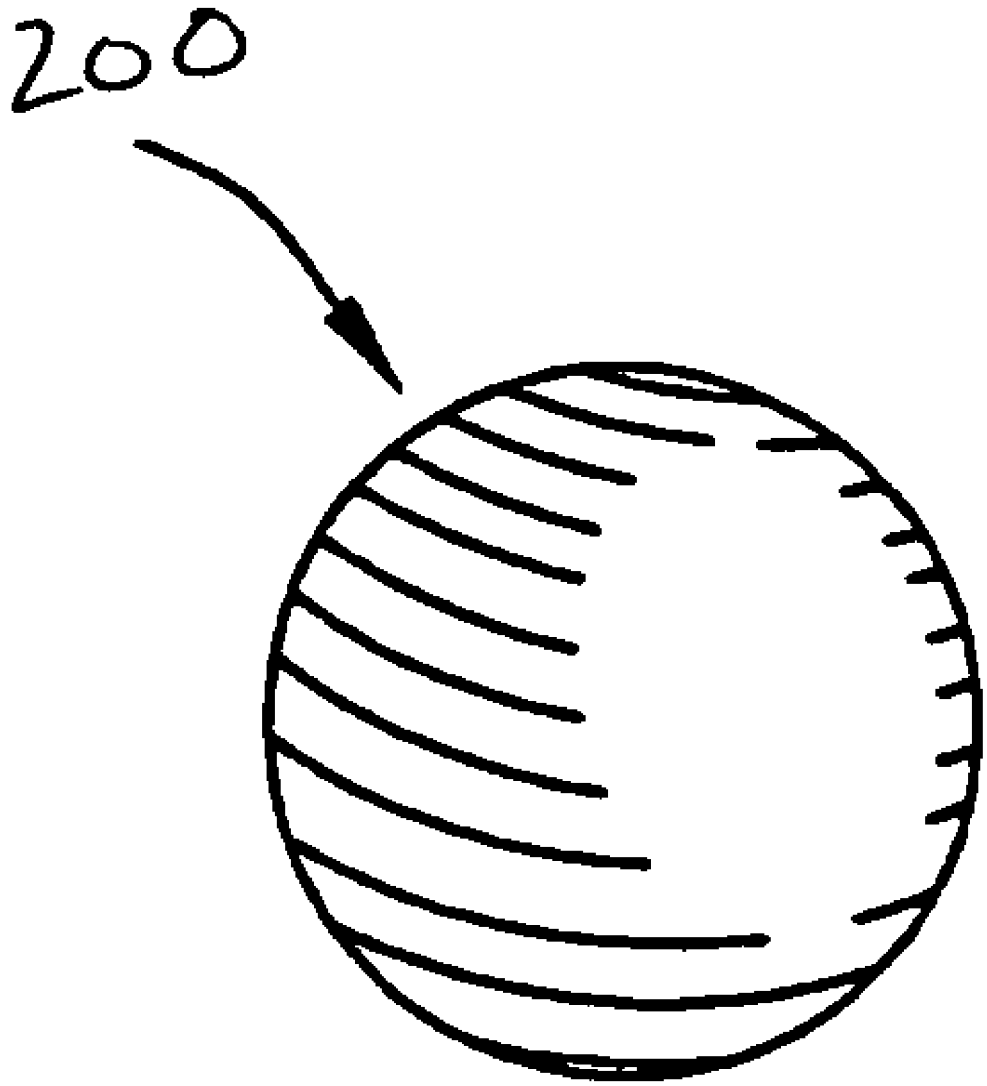
FIG. 2 illustrates a spherical pellet according to one embodiment of the disclosure.

FIG. 2 illustrates a pellet according to one embodiment of the disclosure. In FIG. 2, an exemplary lamp fill pellet 200 is shown to be generally spherical. It should be noted that the principles disclosed herein are not limited to a spherically-shaped pellet and may include other geometrical shapes without departing from the disclosure. The pellet 200 may have a composition comprising mercury, bismuth, indium and a metal selected from the group consisting of zinc, tin, lead, silver, gold, copper, gallium, titanium, nickel, and manganese.

The pellets according to the present disclosure may be quaternary. That is, it may consist only of mercury, bismuth, indium, and a metal selected from the group consisting of zinc, tin, lead, silver, gold, copper, gallium, titanium, nickel, and manganese (with such minor impurities as may be introduced in the manufacturing process). In other embodiments, the pellets may comprise mercury, bismuth, indium and two or more metals selected from the group consisting of zinc, tin, lead, silver, gold, copper, gallium, titanium, nickel, and manganese. In one embodiment, the amalgam is about 99% pure and generally free of oxygen and water.

An example of a suitable composition of a pellet according to the present disclosure includes about 20-70 wt. % indium, 30-80 wt. % bismuth, 0.1-20 wt. % zinc and 0.1-40 wt. % mercury. In still another embodiment, the amalgam composition includes about 28.8 wt. % indium, 67.4 wt. % bismuth, 0.85 wt. % zinc and 2.9 wt. % mercury.

Because the amalgam according to the embodiments of the disclosure can be substantially solid at room temperature, the amount of amalgam for use in a lamp can be easily quantified and dispensed. For example, small pellets of generally uniform mass and composition may be formed with any shape that is appropriate for the manufacturing process, although spherical pellets are the most easily handled. Typical spherical pellet diameters may be about 200-3500 microns.

The generally spherical pellets may have substantially uniform mass and composition and may be made by rapidly solidifying or quenching an amalgam melt, such as, by the method and apparatus disclosed in U.S. Pat. No. 4,216,178, the disclosure of which is incorporated herein by reference. The pellets can have a predetermined and substantially uniform mass (±15%) in the range of about 0.05-200 milligrams. Other conventional techniques for pelletizing the amalgam melt may include casting or extrusion. The pellets may be weighed, counted or measured volumetrically and introduced into the lamp by conventional techniques. For example, a lamp that requires 5 mg of mercury may use 4 pellets, each 2.5 wt. % mercury and weighing at about 50 milligrams or it may use one 200 milligram pellet of similar composition.

A process according to one embodiment of the disclosure includes forming a molten mixture containing mercury, bismuth, indium and another metal and rapidly quenching the mixture. The resulting microstructure of the quenched pellets may be in a non-equilibrium state similar to the material disclosed in U.S. Pat. No. 5,882,237, the specification of which is incorporated herein by reference. The mercury may exist in the mixture as a liquid amalgam, a solid amalgam or both. The material may be free flowing even if the mercury is present as a liquid amalgam. In one embodiment, the metal zinc is added and may appear in these materials as zinc solid solution or as the intermetallic compound $Zn_3Hg$ or as both.

Figure 3:
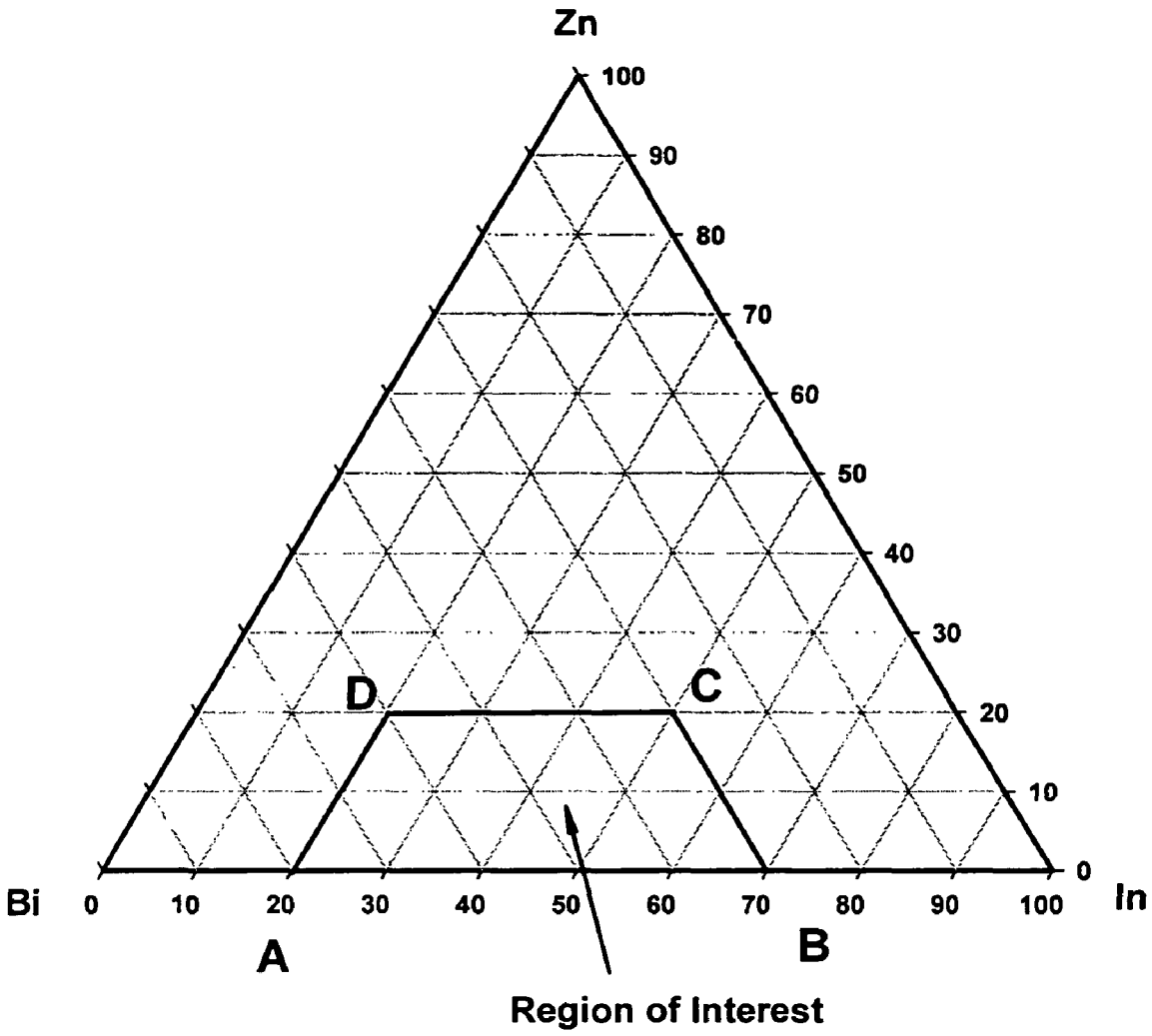
FIG. 3 is the phase diagram for bismuth, indium and zinc.

FIG. 3 is a phase diagram for bismuth, indium and zinc. A Bi—In—Zn composition according to one embodiment is depicted as a trapezoid bounded by point A (20 wt. % indium, 80 wt. % bismuth), point B (70 wt. % indium, 30 wt. % bismuth), point C (20 wt. % zinc, 50 wt. % indium, 30 wt. % bismuth), and point D (20 wt. % zinc, 20 wt. % indium, 60 wt. % indium.) The compositions defined by the trapezoid ADCB may additionally contain about 0.1-40 wt. % mercury.

The pellets according to the present disclosure may not behave as predicted by the equilibrium phase diagram and may not be at equilibrium. Instead, the amalgam may be in a metastable, non-equilibrium state. The amalgam pellet may contain zinc-rich exterior portions and mercury-rich interior portions. It may also contain regions rich in indium bismuthide (InBi) within the interior of spherical pellet.

Figure 4:
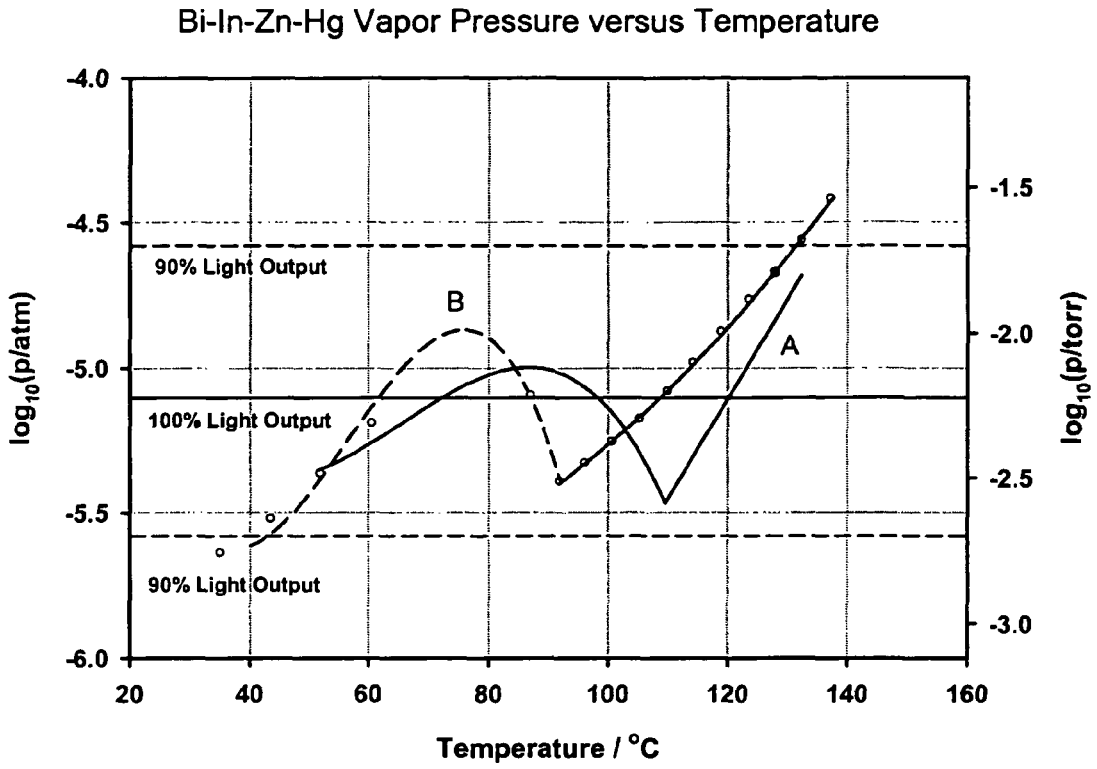
FIG. 4 comparatively shows the vapor pressure of a composition according to one embodiment of the disclosure.

FIG. 4 illustrates the vapor pressure of a composition according to one embodiment of the disclosure as compared to a conventional composition. More specifically, curve A of FIG. 4 shows the vapor pressure of a prior art composition having Bi—In—Hg, while curve B shows the vapor pressure of a composition according to the present disclosure having Bi—In—Hg—Zn. As is illustrated in FIG. 4, the addition of zinc to an amalgam of bismuth, indium and mercury does not adversely affect the mercury vapor pressure regulating properties of the fill material, while gaining the advantages of providing a fill material that is free flowing at room temperature.

Mercury weight loss from a Bi—In—Hg made according to the present invention is given in Table 1. The amalgams are able to release their mercury when heated to 300° C. for 30 minutes.

TABLE 1

Results for Mercury Weight Loss

| Exp. No. | Initial Wt. (mg) | Final Wt. (mg) | Wt. Loss (%) | Hg Amount (%) |
|---|---|---|---|---|
| 1 | 6.348 | 6.13 | 3.43% | 3.03% |
| 2 | 6.613 | 6.43 | 2.77% | 3.03% |
| 3 | 5.961 | 5.79 | 2.87% | 3.03% |
| 4 | 6.123 | 5.95 | 2.83% | 3.03% |

Other advantageous embodiments of the disclosure can be seen from the following examples.

EXAMPLE 1

A sample containing 68.2 grams of bismuth, 30.1 grams of indium, 0.7 grams of zinc, and 1 gram of mercury was made into 1000 micron spheres by the method discussed in U.S. Pat. No. 4,216,178. The resulting pellets were smooth and free flowing

EXAMPLE 2

A sample containing 67.7 grams of bismuth, 29.4 grams of indium, 0.3 grams of manganese and 2.7 grams of mercury was made into 1000 micron spheres by the method of Anderson. The resulting pellets were smooth and free flowing.

While preferred embodiments are disclosed and/or discussed herein, it is to be understood that the embodiments described are illustrative only and the scope of the invention is to be defined solely by the appended claims when accorded a full range of equivalence, many variations and modifications naturally occurring to those skilled in the art from a perusal thereof.

I claim:

1. A solid lamp fill material for delivering a precise dose of mercury into a fluorescent lamp and for regulating the mercury vapor pressure during operation of the lamp, said material comprising bismuth, indium, mercury, and a metal forming one or more intermetallic phases with the mercury selected from the group consisting of zinc, gold, copper, gallium, titanium, nickel, and manganese, said material having an atomic ratio of indium to bismuth within the range of about 0.4:0.6 to 0.7:0.3.

2. The solid lamp fill material of claim 1, wherein said metal is selected from the group consisting of zinc, gold, copper, and titanium.

3. The solid lamp fill material of claim 1 wherein said metal is zinc.

4. The solid lamp fill material of claim 1 wherein said metal is manganese.

5. A pellet for delivering a precise dose of mercury into a fluorescent lamp and for regulating the mercury vapor pressure during operation of the lamp, said pellet comprising mercury, bismuth, indium and a metal selected from the group consisting of zinc, gold, copper, gallium, titanium, nickel, and manganese, said pellet having an atomic ratio of indium to bismuth within the range of about 0.4:0.6 to 0.7:0.3.

6. The pellet of claim 5 wherein said metal is selected from the group consisting of zinc, copper, and manganese.

7. The pellet of claim 6 wherein said metal is zinc.

8. The pellet of claim 7 wherein the zinc is in a metastable, non-equilibrium state.

9. The pellet of claim 6 further comprising copper.

10. The pellet of claim 6 wherein said metal is manganese.

11. A plurality of pellets according to claim 5 wherein the pellets are free-flowing.

12. A solid lamp fill material forming a plurality of free-flowing pellets at substantially room temperature, each suitable for delivering a precise dose of mercury into a fluorescent lamp and for regulating the mercury vapor pressure during operation of a lamp, said pellets comprising bismuth and indium for regulating the vapor pressure of the mercury during operation of a lamp, and one or more intermetallic phases of mercury and a fourth metal for preventing agglomeration of the pellets, said fourth metal being selected from the group consisting of zinc, copper and manganese, said material having an atomic ratio of indium to bismuth within the range of about 0.4:0.6 to 0.7:0.3.

13. A pellet comprising mercury, bismuth and indium having an atomic ratio of indium to bismuth within the range of about 0.4:0.6 to 0.7:0.3, and an intermetallic phase of mercury and a metal selected from the group consisting of zinc, gold, copper, gallium, titanium, nickel, and manganese.

14. The pellet of claim 13 comprising an intermetallic phase of mercury and zinc.

15. The pellet of claim 13 comprising an intermetallic phase of mercury and copper.

16. The pellet of claim 13 comprising an intermetallic phase of mercury and manganese.

17. The pellet of claim 13 wherein the atomic ratio of said metal to the combination of indium and bismuth is within the range of about 0.01:0.99 to 0.20:0.80.

18. The pellet of claim 13 wherein the atomic ratio of mercury to the combination of indium, bismuth and said metal is within the range of about 0.01:0.99 to 0.15:0.85.

19. The pellet of claim 13 comprising zinc.

20. The pellet of claim 19 further comprising one or more metals from the group consisting of tin, lead, silver, gold, copper, manganese or gallium, titanium and nickel.

21. The pellet of claim 13 comprising manganese.

22. A pellet for dosing mercury into a fluorescent lamp and for regulating the mercury vapor pressure during operation of the lamp, said pellet comprising bismuth, indium, zinc and mercury, wherein the atomic ratio of indium to bismuth is within the range of about 0.4:0.6 to 0.7:0.3; wherein the atomic ratio of zinc to the combination of indium and bismuth is within the range of about 0.01:0.99 to 0.20:0.80, and wherein the atomic ratio of mercury to the combination of indium, bismuth and zinc is within the range of about 0.01:0.99 to 0.15:0.85.

23. The pellet of claim 22 comprising about 28.8 wt. % indium, 67.4 wt. % bismuth, 0.85 wt.% zinc, and 2.9 wt. % mercury.

24. The pellet of claim 22 wherein the atomic ratio of mercury to zinc is within the range of about 0.25:1 to about 5:1.

25. The pellet of claim 22 wherein the bismuth and indium comprise about 50-98 wt. % of the pellet.

26. An amalgam controlled fluorescent lamp containing one or more pellets for regulating the mercury vapor pressure in said lamp, one or more of said pellets comprising bismuth, indium, mercury, and manganese.

27. A pellet for dosing mercury into a fluorescent lamp, said pellet comprising bismuth, indium, manganese and mercury, wherein the atomic ratio of indium to bismuth is within the range of about 0.4:0.6 to 0.7:0.3; wherein the atomic ratio of manganese to the combination of indium and bismuth is within the range of about 0.01:0.99 to 0.20:0.80, and wherein the atomic ratio of mercury to the combination of indium, bismuth and manganese is within the range of about 0.01:0.99 to 0.15:0.85.

28. The pellet of claim 27 comprising about 29.4 wt. % indium, 67.7 wt. % bismuth, 0.3 wt.% manganese and 2.7 wt. % mercury.

29. The pellet of claim 27 wherein the atomic ratio of mercury to manganese is within the range of about 0.05:1 to about 5:1.

30. The pellet of claim 27 wherein the bismuth and indium comprise about 50-98 wt. % of the pellet.

* * * * *